US012247380B1

(12) United States Patent
Panton

(10) Patent No.: US 12,247,380 B1
(45) Date of Patent: Mar. 11, 2025

(54) COMBINATION TOILET-SINK ASSEMBLY

(71) Applicant: Troy-Moses Panton, Palm Bay, FL (US)

(72) Inventor: Troy-Moses Panton, Palm Bay, FL (US)

( * ) Notice: Subject to any disclaimer, the term of this patent is extended or adjusted under 35 U.S.C. 154(b) by 0 days.

(21) Appl. No.: 18/774,849

(22) Filed: Jul. 16, 2024

(51) Int. Cl.
*E03D 1/00* (2006.01)
*E03C 1/18* (2006.01)
*E03D 11/02* (2006.01)

(52) U.S. Cl.
CPC ..... *E03D 1/003* (2013.01); *E03C 1/18* (2013.01); *E03D 11/025* (2013.01)

(58) Field of Classification Search
CPC ..... E03D 11/12; E03D 11/025; E03D 1/003
See application file for complete search history.

(56) References Cited

U.S. PATENT DOCUMENTS 2,184,722 A * 12/1939 McLoughlin ..... E03C 1/324 4/DIG. 2
2,202,486 A * 5/1940 Fredrickson ..... E03D 11/12 4/312
2,860,348 A * 11/1958 McClenahan ..... E03D 1/003 4/665
3,719,959 A 3/1973 Ekstrom
3,829,906 A * 8/1974 McPhee ..... E03D 11/12 4/300
3,887,947 A 6/1975 Tosca
4,030,145 A * 6/1977 Rowan ..... E03D 11/025 4/300
4,089,073 A * 5/1978 Campbell ..... E03D 11/025 4/312
4,177,527 A 12/1979 Uhlig
4,718,131 A * 1/1988 Kitamura ..... A47K 4/00 4/312
5,345,619 A * 9/1994 Harrington ..... E03D 1/003 4/341
5,813,047 A * 9/1998 Teichroeb ..... E03D 5/006 4/364
6,119,285 A 9/2000 Kim
6,185,759 B1 2/2001 Satudenmeyer
(Continued)

FOREIGN PATENT DOCUMENTS

CN 2166167 Y 5/1994
CN 104652564 A 5/2015
(Continued)

*Primary Examiner* — Erin Deery
(74) *Attorney, Agent, or Firm* — Brian Roffe

(57) ABSTRACT

Combination toilet and sink assembly includes a base defining a waste receptacle having an outlet, an optional reservoir tank, a first conduit in the base extending from an outlet of the reservoir tank to the waste receptacle, a second conduit in the base extending from an outlet of the waste receptacle to an outlet from the base, and a sink having a drain. A conduit member is connected to the sink drain and extends therefrom to a channel of the base. The conduit member defines part of a third conduit from the drain to the waste receptacle and is pivotable about a vertical axis. A faucet may be coupled to the conduit member such that both the faucet and the conduit member/sink are pivotable. A fourth conduit has an inlet connectable to a water source and an outlet communicating with an inlet of a spout of the faucet.

20 Claims, 11 Drawing Sheets

(56) References Cited

U.S. PATENT DOCUMENTS

| | | | | | |
|---|---|---|---|---|---|
| D469,521 | S * | 1/2003 | Cummings | ..... | D23/274 |
| 8,490,225 | B2 | 7/2013 | Saxby | | |
| 11,519,163 | B2 * | 12/2022 | Braxton | ..... | E03D 1/003 |
| 2011/0047694 | A1 | 3/2011 | Dang | | |
| 2013/0081202 | A1 | 4/2013 | Shen | | |
| 2021/0340747 | A1 | 11/2021 | Braxton | | |

FOREIGN PATENT DOCUMENTS

| | | | | | |
|---|---|---|---|---|---|
| CN | 214942815 | U | 11/2021 | | |
| EP | 0074934 | A2 | 3/1983 | | |
| FR | 2856416 | A1 * | 12/2004 | ..... | E03D 1/003 |
| GB | 2285993 | A | 2/1995 | | |
| GB | 2334267 | A | 8/1999 | | |
| GB | 2436838 | A * | 10/2007 | ..... | A47K 4/00 |
| GB | 2454703 | A | 5/2009 | | |
| IE | 20130327 | A1 | 9/2013 | | |
| KR | 20110089384 | A | 8/2011 | | |

* cited by examiner

© Copyright 2025 Thomson Reuters

© Copyright Troy State Patent

© Copyright Troy Alexander Parker 2025

US Patent and Trademark Office / Alexandria, VA 22314

© Copyright 2025 Patent Research Society / Patent Docs

© Copyright Thyssenkrupp Presta AG

COMBINATION TOILET-SINK ASSEMBLY

FIELD OF THE INVENTION

The present invention relates generally to a combination toilet-sink assembly, also referred to sometimes as a combined toilet and sink unit, wherein the toilet and sink are provided as a single unit but usable at different times.

BACKGROUND OF THE INVENTION

It has been considered to integrate a sink or wash basin into a toilet to provide a compact bathroom fixture. For example, GB 2285993 (Loveday) describes a wash basin coupled to a tank of a toilet. The sink sits securely on top of the toilet tank, e.g., recessed therein, and its pipework is coupled with the flushing tank and toilet assembly.

Similarly, GB 2334267 (Jarrett) describes a water closet tank lid formed with a bowl with a drainage aperture passing through the material of the lid and communicating in use with the interior of the tank. The lid includes an upstanding spout or spigot secured in the material of the lid or of the body of the tank. A flexible hose couples the spout or spigot to the supply of water fed to the tank when the tank is flushed.

Also, GB 2454703 (Edwards) describes a toilet and sink arrangement including a floor mounted toilet bowl with a tank containing water for flushing the toilet. A sink bowl and tap are arranged on the tank, and waste water from the sink bowl flows into the tank below. When the toilet tank fills, following flushing, clean water is supplied both to the tap and the tank until the tank is sufficiently full of water.

U.S. Pat. No. 6,119,285 (Kin) describes a lavatory fixture having a combination, urinal and hand wash faucet for public restrooms. The lavatory fixture has a urinal and hand sink combined in a single lavatory unit with a self-activated hand faucet positioned above a urinal catch basin. The hand faucet has an associated proximity sensor to activate a water flow for washing hands, when a user's hands are placed proximate the faucet. The urinal has an associated proximity sensor for sensing the presence of a user proximate the urinal to flush the urinal when the user moves away from the urinal. The lavatory fixture has a common drain and an optional hand soap dispenser.

U.S. Pat. No. 8,490,225 (Saxby) describes a sanitary unit including a toilet having a bowl provided with a seat, and a wash basin supported above the toilet bowl. The wash basin is mounted for sliding movement between a retracted position in which there is access to the toilet bowl, and a forward position in which the wash basin is to be used. The toilet bowl is mounted for simultaneous sliding movement between a retracted position and a forward position in which the toilet bowl is to be used, under the action of a mechanism which interconnects the toilet bowl and the basin U.S. Pat. Appln. Publ. No. 20110047694 (Dang) describes a plumbing fixture including a wash basin positioned above a bodily waste receptacle. A transition compartment is connected between the wash basin and the bodily waste basin for directing flow of fluid from the wash basin into the bodily waste basin.

U.S. Pat. Appln. Publ. No. 20130081202 (Shen) describes a folding bathroom sink toilet system that saves space and water. The folding sink has the same width as the toilet tank and is not visible when in folded position. This system includes a sink, a semicircle drain outlet and sink overflow assembly with elastic and bendable head coupling the sink and toilet tank, a collapsible cabinet and washing platform, an adjustable hinge to hold the sink in the folding or deployed position, a dual-float water valve with pipe tee to control sink water supply to toilet tank, a water level indicator with three adjustable floating switches showing toilet tank's water in full, half full or empty, and push-button switches for adding water to the toilet and flushing.

U.S. Pat. Appln. Publ. No. 20230340747 (Braxton) describes a water and space saving bathroom component including a novel toilet having a tank with a sink in combination with the toilet, a novel waterless urinal and a hand sanitizer dispensing station. The sink is an integrally formed sink into the top of the tank and has a drain formed into the sink for draining effluent from the sink into the toilet tank. A faucet is installed in the surface of the sink to provide a clean water source for hand washing and the like that generates grey water after washing. The waterless urinal can be plumbed and mounted to a comfort station wall or on a mobile stand, while the hand sanitizer dispensing station may be adapted for multiple dispensers.

Also of interest, CN 214942815U describes an integrated bathroom unit including a toilet, a shower assembly and a wash basin that fold upward and each can be folded downward into a use position when needed. IE 20130327 (Dowling) describes a sanitary unit (toilet) having a water inlet sealably connected to the waste water pipe outlet pipe of another sanitary unit (sink), such that a secure connection seal is achieved between the inlet pipe of the sanitary unit (toilet) and the outlet pipe of the second sanitary unit (sink). The sanitary unit (toilet) is adapted to receive, as its water flushing supply, waste water from the other sanitary unit (sink). EP 0074934 (Crocoli) describes a folding sink-toilet unit, wherein both are capable of being folded from a horizontal working position to a recessed vertical position in which they are enclosed within a furniture piece.

CN 104652564A (Li) describes a water-saving toilet with a hand washing sink in which water is directly drained and wasted after having been used for washing hands since a water supply system and a water drainage system of a hand washing sink and a toilet of an existing bathroom are separated and the water can be used for flushing the toilet after being used for washing hands. A drainage pipe of the hand washing sink extends into a water storage tank of the toilet body. CN 2166167Y (Sun et al.) describes a water-saving toilet with a hand washing sink that includes a hand washing sink drain pipe, a toilet bowl, and a toilet water storage tank. The device can control a floating ball in the water storage tank through a linkage part with the hand washing pool, thereby supplementing water injection. KR 20110089384A (Kim) describes a toilet cover with an integrated sink to enable a user to utilize the bathroom space, and to cover a toilet using a toilet cover when necessary. The plastic sink is rotated by using a hook connected to a rod or the wall surface.

None of these structures provide for a sink that is pivotable about a vertical axis to be able to be pivoted between a position over the toilet, in which use of the toilet is not possible but use of the sink is possible, to a position to a side of the toilet in which use of both the toilet and the sink are possible, if so desired.

OBJECTS AND SUMMARY OF THE INVENTION

It is an object of at least one embodiment of the present invention to provide a new and improved combination toilet and sink assembly.

It is another object of at least one embodiment of the present invention to provide a new and improved combination toilet and sink assembly wherein waste water from the sink is directed into the toilet bowl.

It is another object of at least one embodiment of the present invention to provide a new and improved combination toilet and sink assembly wherein the toilet can be used at different times than the sink.

It is another object of at least one embodiment of the present invention to provide a new and improved combination toilet and sink assembly in which the sink swings away from a position over the toilet bowl to enable access to the toilet.

It is yet another object of at least one embodiment of the present invention to provide a new and improved combination toilet and sink assembly wherein the sink is able to be swung to both sides of the toilet bowl, i.e., to the right and left sides of the toilet bowl.

It is yet another object of at least one embodiment of the present invention to provide a new and improved combination toilet and sink assembly wherein the sink is able to be swung about a vertical axis relative to the toilet bowl, i.e., to be swung to one or both sides of the toilet bowl.

In order to achieve one or more of the above objects, or possibly others, a combination toilet and sink assembly in accordance with one embodiment of the invention includes a base defining a water inlet, a waste receptacle having an outlet in a bottom region and a channel leading into the waste receptacle separate from the water inlet, a first conduit in the base extending from the water inlet of the base to the waste receptacle, and a second conduit in the base extending from the outlet of the waste receptacle to an outer surface of the base at a vertical height below the outlet of the waste receptacle to enable outflow of waste water from the waste receptacle from the base. A conduit is a channel, and passage in the base, or other structure, through which water flows. The assembly also includes a sink having a drain, and a conduit member connected at one end region to the drain of the sink and extending from the drain of the sink to the channel of the base, and which conduit member also defines part of a third conduit from the drain to the waste receptacle and is pivotable about a substantially vertical axis such that the sink pivots upon pivotal movement of the conduit member. The assembly also includes a pivotable faucet having a spout, a water inlet to the spout, and a water outlet from the spout at a vertical height above the sink, and a fourth conduit having a water inlet adapted to be coupled to a source of water and a water outlet communicating with the water inlet of the spout of the faucet. The first conduit is in fluid communication with a source of water to enable controllable inflow of water from the water source into the water inlet and through the first conduit into the waste receptacle. The inflow of water from the water outlet of the fourth conduit to the spout of the faucet is controllable.

In one embodiment, the faucet includes a handle for controlling flow of water from the water outlet of the fourth conduit to the water inlet of the spout of the faucet and then through the spout to the water outlet of the spout of the faucet. The faucet may be pivotable about the same substantially vertical axis as the sink, or a different substantially vertical axis.

In a preferred embodiment, the assembly includes a reservoir tank coupled to the base and having a water receptacle, a water inlet to the water receptacle adapted to be coupled to a source of water and a water outlet from the water receptacle at a bottom region of the reservoir tank at a vertical height above at least part of the waste receptacle. The first conduit extends from the water outlet of the reservoir tank to the waste receptacle to enable inflow of water from the water outlet of the reservoir tank into the waste receptacle. The inflow of water from the water outlet of the reservoir tank into the waste receptacle is controllable. The reservoir tank includes a protrusion on a front side on which the faucet is supported, and a portion of the fourth conduit passes through the protrusion. The first conduit extends from the water outlet of the reservoir tank to an upper region of the waste receptacle and is at least partly formed in an upper region of the base. The fourth conduit is defined partly in the reservoir tank and partly in the base.

In some embodiments, the conduit member is configured to be pivotable between a first position in which the sink is in a position directly above at least part of the waste receptacle and a second position in which the sink is in a position not above the waste receptacle to enable use of the waste receptacle. The second position may be about 90 degrees about the vertical axis from the first position.

There may be a casing that encloses a portion of the conduit member between the drain and the base. As such, the faucet is coupled to the casing to provide for linked pivotal movement of the sink, the conduit member, the casing and the faucet. When there is the reservoir tank, an alignment pin may be arranged partly in an aperture in the casing and partly in an aperture in the reservoir tank above the casing to thereby facilitate the pivotal movement of the casing and a portion of the conduit member enclosed thereby.

The base may include a projection alongside the waste receptacle that includes a portion of the fourth conduit and a channel in which a portion of the conduit member is situated. When the reservoir tank is present, the projection is rearward of the waste receptacle which is rearward of the projection, and the portion of the fourth conduit is rearward of the channel to allow for pivotal movement of the sink to both sides of the base. The conduit member includes a vertical portion rotatable in the channel and a horizontal portion above the vertical portion and at least partly under the sink. The channel in the base is rearward of the waste receptacle, under the channel in the projection and in flow communication with the vertical portion of the conduit member.

Also in accordance with the invention is a toilet for a combination toilet and sink assembly that includes essentially only the toilet-related components of the assembly described above (and is not limited to use with the disclosed sink portion of the assembly), namely, a base defining a water inlet, a waste receptacle having an outlet in a bottom region and a channel leading into the waste receptacle separate from the water inlet, a first conduit in the base extending from the water inlet of the base to the waste receptacle, and a second conduit in the base extending from the outlet of the waste receptacle to an outer surface of the base at a vertical height below the outlet of the waste receptacle to enable outflow of waste water from the waste receptacle from the base. The toilet also includes a projection on the base alongside the waste receptacle and that includes a channel in flow communication with the channel in the base and is adapted to receive a conduit member that defines a third conduit, and a fourth conduit defined partly in the projection of the base and having a water inlet adapted to be coupled to an external source of water and a water outlet. The first conduit in the base is in fluid communication with a source of water to enable controllable inflow of water from a source of water into the water inlet and through the first conduit into the waste receptacle. When the toilet is connected to a sink having a faucet and a drain, the conduit member received in the channel of the projection is connected to a drain of the sink and the water outlet of the fourth conduit is coupled to a water inlet of the faucet.

Also in accordance with the invention is a sink for a combination toilet and sink assembly that includes essentially only the sink-related components of the assembly described above (and is not limited to use with the disclosed toilet portion of the assembly), namely a sink having a drain, a conduit member connected at one end region to the drain of the sink and which defines part of a first conduit from the drain and includes a vertical portion and a horizontal portion above the vertical portion and at least partly under the sink, and a pivotable faucet having a spout, a water inlet to the spout, and a water outlet from the spout at a vertical height above the sink. The faucet may be coupled to the sink such that upon pivotal movement of the conduit member, the sink and the faucet pivot. The faucet includes a handle for controlling flow of water through the spout from the water inlet of the spout to the water outlet of the spout. Upon placement of the vertical portion of the conduit member into a channel of a toilet base, the conduit member is pivotable. Upon connection of the water inlet of the spout of the faucet to a second conduit passing through the toilet base, water is suppliable to the spout.

The following embodiments and aspects thereof are described and illustrated in conjunction with systems, tools and methods which are meant to be exemplary and illustrative, but not limiting in scope. In various embodiments, one or more of the above-described problems have been reduced or eliminated, while other embodiments are directed to other advantages or improvements.

A better understanding of the disclosed assembly will be obtained from the following detailed description of the preferred embodiments, taken in conjunction with the drawings and the attached claims.

BRIEF DESCRIPTION OF THE DRAWINGS

Some embodiments of the invention are described herein with reference to the accompanying figures. The description, together with the figures, make apparent to a person having ordinary skill in the art how some embodiments may be practiced. The figures are for the purpose of illustrative description and no attempt is made to show structural details of an embodiment in more detail than is necessary for a fundamental understanding of the invention. For the sake of clarity, some objects depicted in the figures are not to scale.

DETAILED DESCRIPTION OF THE INVENTION

Figure 1:
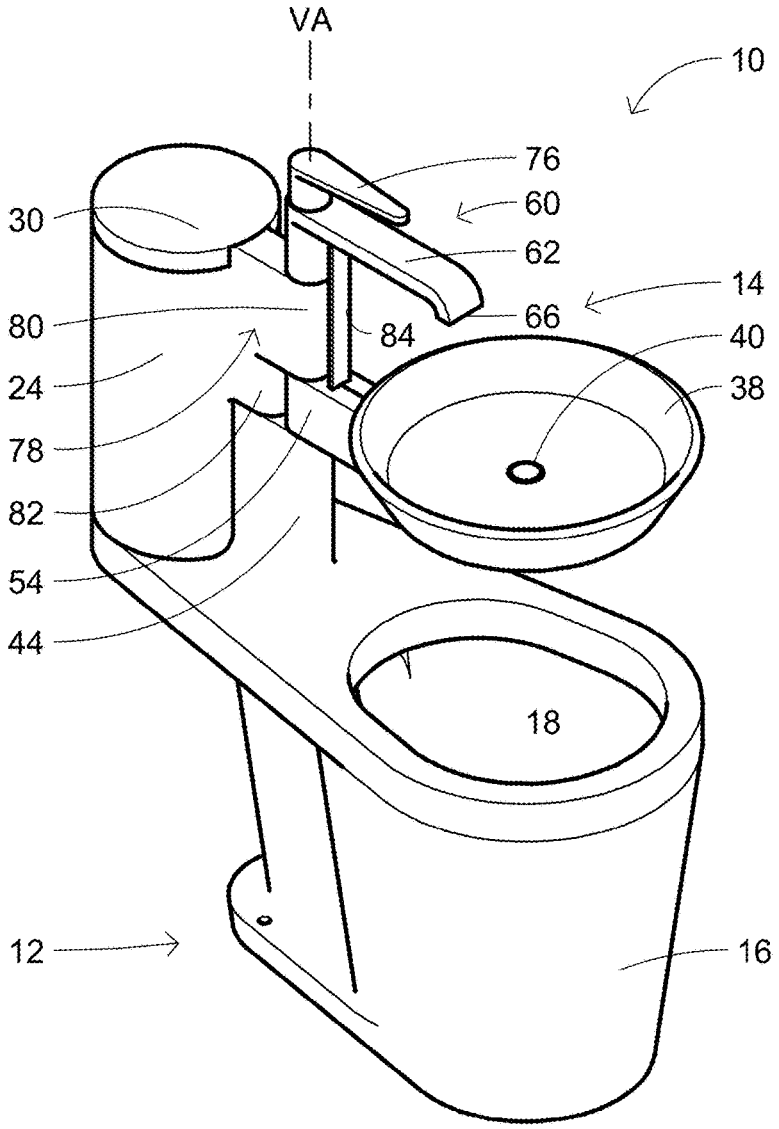
FIG. 1 is a front, left side perspective view of a combination toilet and sink assembly in accordance with the invention.
Figure 2:
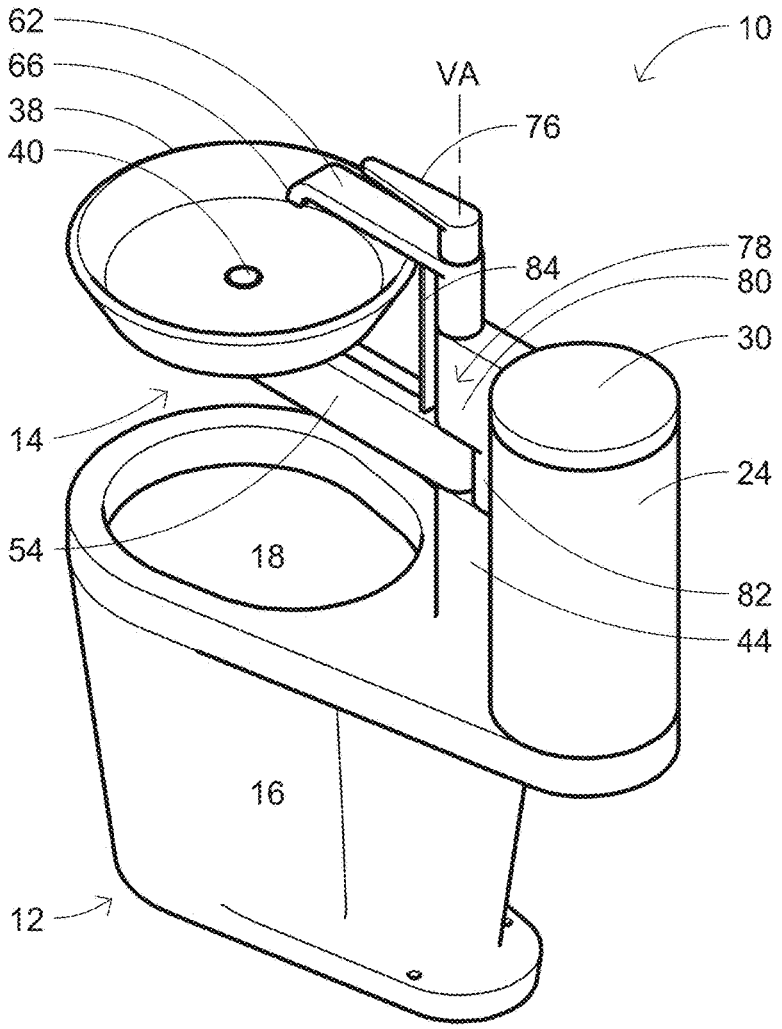
FIG. 2 is a rear, right side perspective view of the combination toilet and sink assembly shown in FIG. 1.

Referring to the accompany drawings wherein the same reference numbers refer to the same or similar elements, FIG. 1 shows a combination toilet and sink assembly in accordance with the invention, also referred to as a combined toilet and sink unit, and is designated generally as 10. By providing the toilet and sink as a common unit, it is meant that they share a common base, i.e., the base of the toilet or what is commonly known as the toilet bowl, and the sink does not have a conventional support structure such as a vanity or legs. Rather, the sink is supported by and on the toilet base and the water connections for the sink are at least partly integrated into the toilet base. Thus, when installing the toilet and sink unit, the installer has only to handle a single unit, place the single unit on the structure built to accommodate the toilet (which may be a conventional drain and securing bolts) and then make flow connections for the toilet and additional flow connections for the sink, namely, only an intake water supply for the sink. The outlet from the sink is the same as the outlet from the toilet and therefore a separate outlet connection from the unit for the sink is not necessary.

The assembly 10 includes a toilet portion 12 which is used in the conventional manner in which a toilet is used. Components of the toilet portion 12 that are not essential to the invention are not shown, it being understood that such components are present in some form to enable use of the toilet in the conventional manner. Such components include a seat, and one or more of bearings, bushings, fasteners, washers, seals, an actuating/flushing mechanism, conduits and their connections, floats and valves. Also, it should be understood that the toilet portion 12 is connected to an external source of water to provide water to enable use of the toilet. The toilet portion 12 thus includes the features disclosed below that are needed to enable a person to urinate or defecate into the toilet bowl (or waste receptacle) and enable removal or flushing of the waste in the bowl, and repeating of this process.

In a similar manner, the assembly 10 includes a sink portion 14 which is used in the conventional manner in which a sink or wash basin is used. Components of the sink portion 14 that are not essential to the invention are not shown, it being understood that such components are present in some form to enable use of the sink in the conventional manner. Such components include one or more of bearings, bushings, fasteners, washers, seals, and conduits and their connections. Also, it should be understood that the sink portion 14 is connected to a source of water, typically an external source of water, to provide clean water to enable use of the sink, and this external source of water may be the same as or different from the external source of water being used to provide water for the toilet portion 12. The sink portion 14 thus includes the features disclosed below that are needed to enable a person to activate a stream of water to, for example, wash their hands, and drainage of this water, and repeating of this process.

The assembly 10 includes a toilet base 16 having a front and rear, and which is formed in any form as a toilet, the illustrated form being for purposes of explaining the invention but is not meant to limit the invention in any manner whatsoever. As with a typical toilet base, the base 16 includes a toilet bowl portion or waste receptacle 18 having an outlet 20 in a bottom region and a channel 22 rearward of and leading into the waste receptacle 18 to enable a flow of water to be used for the flushing to enter into the waste receptacle 18 (see FIG. 10).

A reservoir tank 24 is coupled to a rear portion of the base 16, usually placed onto a rear projecting portion of the base 16 and secured thereto by appropriate securing hardware (not shown). The reservoir tank 24 includes an interior water receptacle 26, a water inlet (not shown) to the water receptacle 26 which is adapted to be coupled to an external source of water (not shown) and a water outlet 28 from the water receptacle 26 at a vertical height above at least part of the waste receptacle 18 (and the flushing hardware (not shown)). The water outlet 28 is preferably in or at a bottom region of the reservoir tank 24. Reservoir tank 24 should be considered an optional feature since there are toilets that do not include such a stabilizer-type tank and instead receive water from a wall-mounted system or are tankless. These alternative toilet portions are within the scope and spirit of the invention.

The reservoir tank 24 has a removable lid 30 to enable access to the interior water receptacle 26 in which typical flushing hardware (not shown) is situated. The reservoir tank 24 and lid 30 are shown in a generally circular cross-section shape but the shape of these elements in the illustrated embodiment is not intended to limit the scope of the invention, and other shapes are contemplated and within the scope of the invention.

Figure 8:
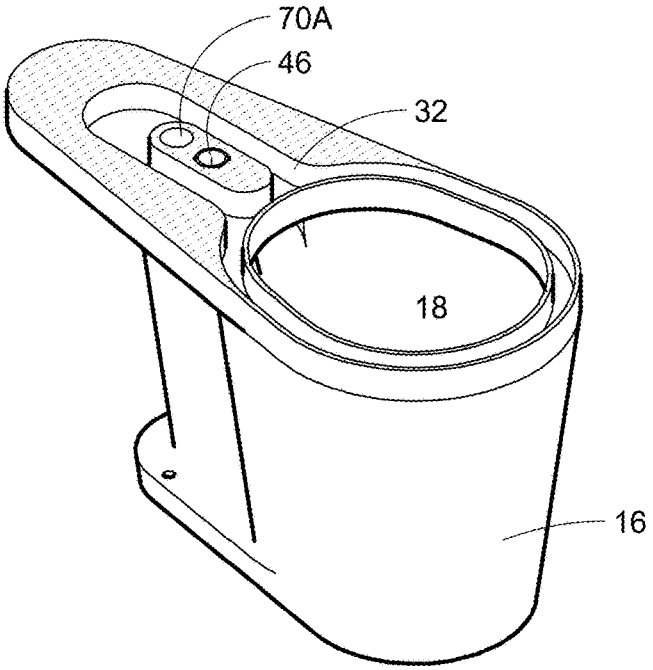
FIG. 8 is a perspective view of the toilet portion of the combination toilet and sink assembly shown in FIG. 1 showing the flow structures for the water from the tank reservoir.

The base 16 includes a first conduit 32 extending from a water inlet 8 of the base 16 aligning with the water outlet 28 of the reservoir tank 24 to the waste receptacle 18, preferably to an upper region thereof, to enable inflow of water from the water receptacle 26 through the water outlet 28 thereof and through the water inlet 8 of the base 16 into the waste receptacle 18. This water inflow is operatively controlled, i.e., upon flushing of the toilet by for example depressing a toilet lever or triggering of a sensor, and operates by the effect of gravity (as in conventional toilets). The first conduit 32 is preferably formed in an upper region of the base 16 and extends from a rearward location at which water first enters the first conduit 32 from the water receptacle 26 in the reservoir tank 24 and includes an annular portion around the upper region of the waste receptacle 18 to potentially reach the front end region of the base 16 (see, e.g., FIG. 8).

After flushing of the toilet, the waste water in the waste receptacle 18 flows out of the waste receptacle 18 and out of the toilet base 16 through a second conduit 34 in the toilet base 16 extending from the outlet 20 of the waste receptacle 18 to an opening 36 in a lower surface of the toilet base 16 at a vertical height below the outlet 20 of the waste receptacle 18, and which is at the rear of the base 16. This vertical difference in height enables outflow of waste water from the waste receptacle 18 to an exterior of the base 16, as in conventional toilets. The location of the outlet 20 of the waste receptacle 18, the location of the opening 36 in the base 16 and the shape of the second conduit 34 therebetween can vary, as is known to those skilled in the art to which this invention pertains.

Figure 9:
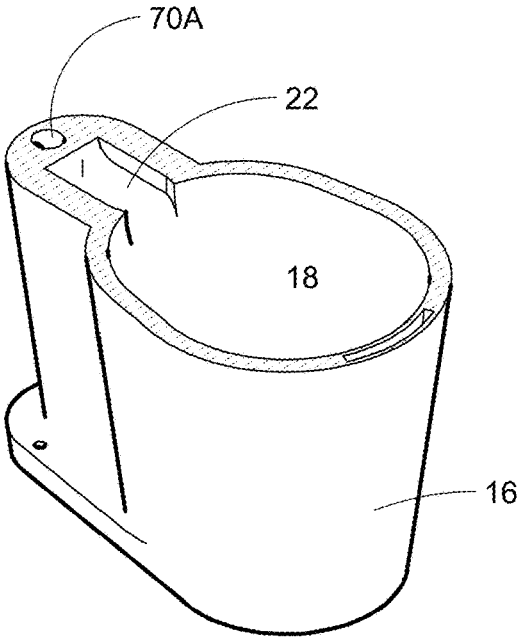
FIG. 9 is a top view of the toilet portion of the combination toilet and sink assembly shown in FIG. 1 showing the flow structure for the water from the faucet drain.

The sink portion 14 of the assembly 10 includes a sink 38 having a drain 40 in a lower region thereof, and a conduit member 42 connected at one end region to the drain 40 of the sink 38. The conduit member 42 extends from the drain 40 of the sink 38 to the channel 22 of the base 16. The conduit member 42 defines part of a third conduit from the drain 40 to the waste receptacle 18 since it is desirable to use the water draining from the sink 38 for the toilet or at least to avoid the need for an additional drain out from the base 16. The sink drain 40 is what is referred to as a trapless sink drain and discharges directly into the toilet bowl or waste receptacle 18 via the channel 22. The channel 22 includes a small chamber with rolled edge to prevent splashing of the water being discharged through the outlet of the conduit member 42 (see FIG. 9).

Figure 10:
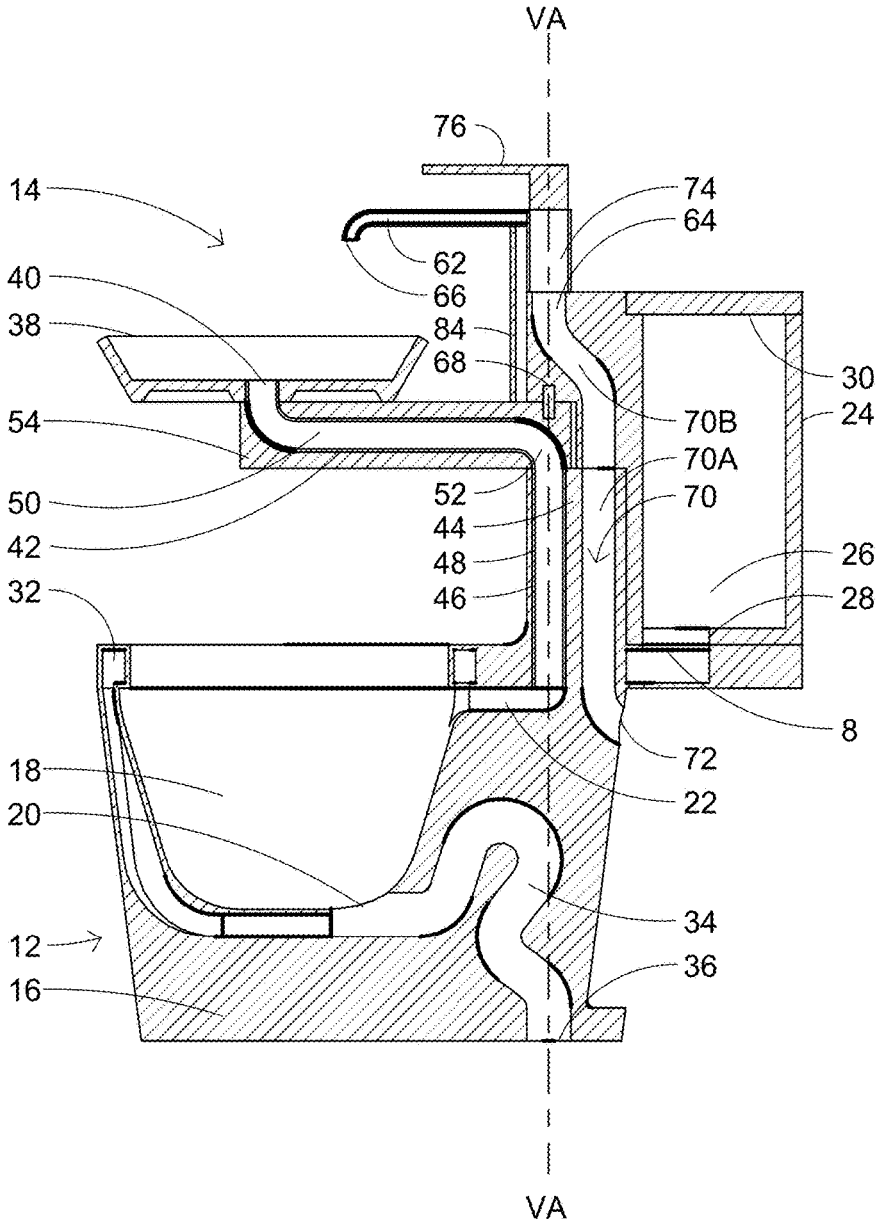
FIG. 10 is a cross-sectional view of the combination toilet and sink assembly shown in FIG. 1 taken through a vertical plane in the approximate center of the combination toilet and sink assembly.
Figure 11:
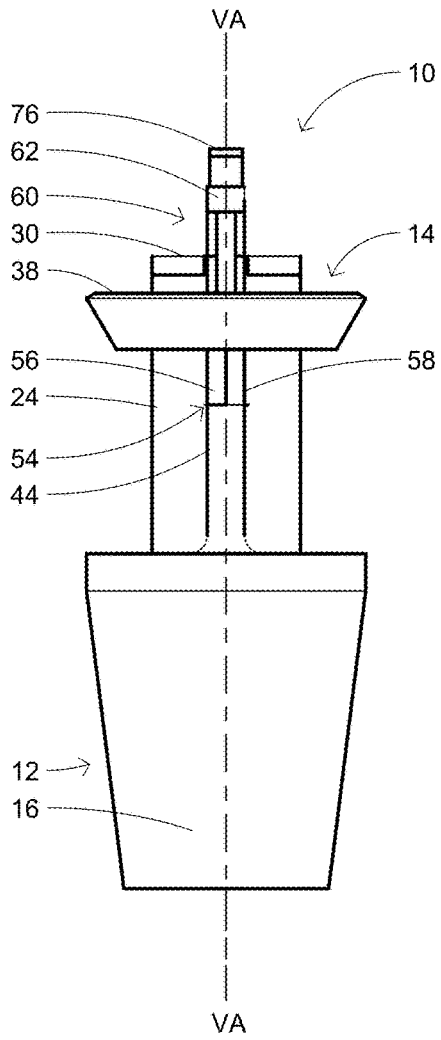
FIG. 11 is a front view of the combination toilet and sink assembly shown in FIG. 1 with the sink portion in a state in which it is above the toilet portion.
Figure 12:
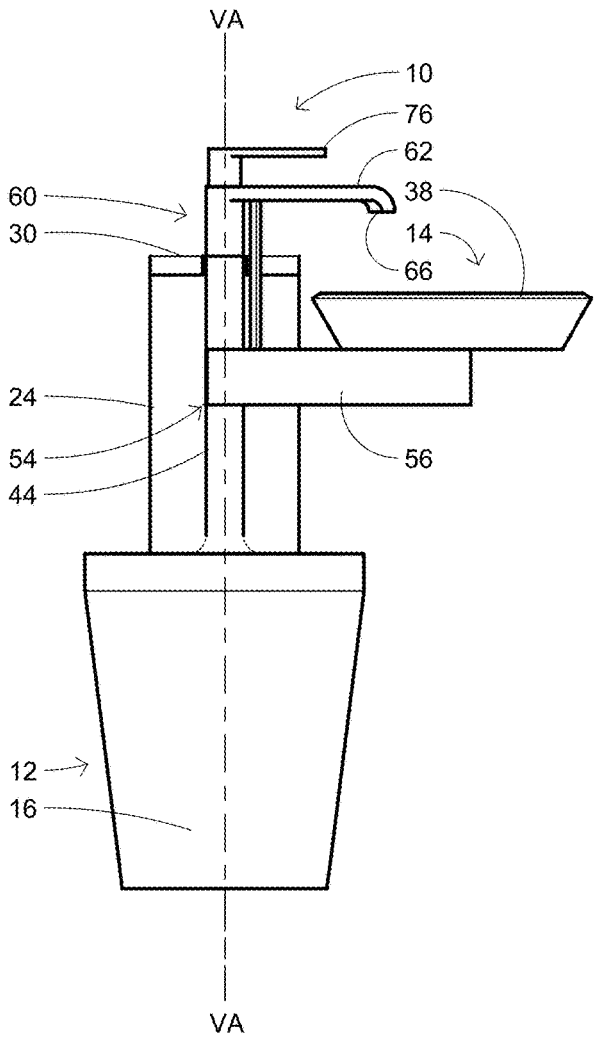
FIG. 12 is a front view of the combination toilet and sink assembly shown in FIG. 1 with the sink portion in a state in which it is not above and to the side of the toilet portion.

Importantly, the conduit member 42 is pivotable about a vertical axis VA such that as the conduit member 42 pivots, the sink 38 connected thereto also pivots (see FIG. 10). More specifically, the conduit member 42 is configured to be pivotable between a first position in which the sink 38 is in a position directly (vertically) above at least part of the waste receptacle 18 (see FIGS. 1, 2, 4, 11 and 14) and a second position in which the sink 38 is in a position completely not (vertically) above the waste receptacle 18 (see FIGS. 5, 12 and 13) to enable use of the waste receptacle 18, i.e., the toilet. The vertical axis VA is preferably perpendicular to the horizontal plane, i.e., the plane onto which the assembly 10 is installed. However, the invention is equally usable if this vertical axis VA is not exactly perpendicular to the horizontal plane and a slight variation from the vertical is possible. The extent of this slight deviation from the vertical would be determined through construction of the assembly 10. An exact vertical axis VA would obviously prevent outflow from the sink 38 of any residual water in the sink 38 after use, but the same effect could be achieved with a slight variation from the vertical and by suitable design of the sink 38. As such, the substantially vertical axis should be considered to 90 degrees to the horizontal plane plus or minus about 10 degrees, i.e., 80 to 100 degrees from the horizontal plane.

Figure 5:
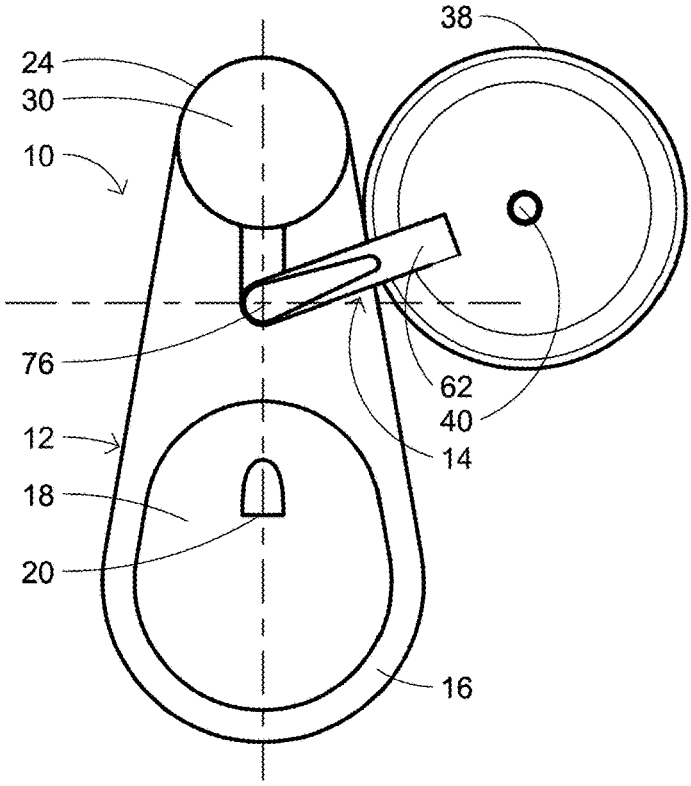
FIG. 5 is a top view of the combination toilet and sink assembly shown in FIG. 1 with the sink portion in a state in which it is not above the toilet portion and thereby allows for use of the toilet portion.
Figure 6:
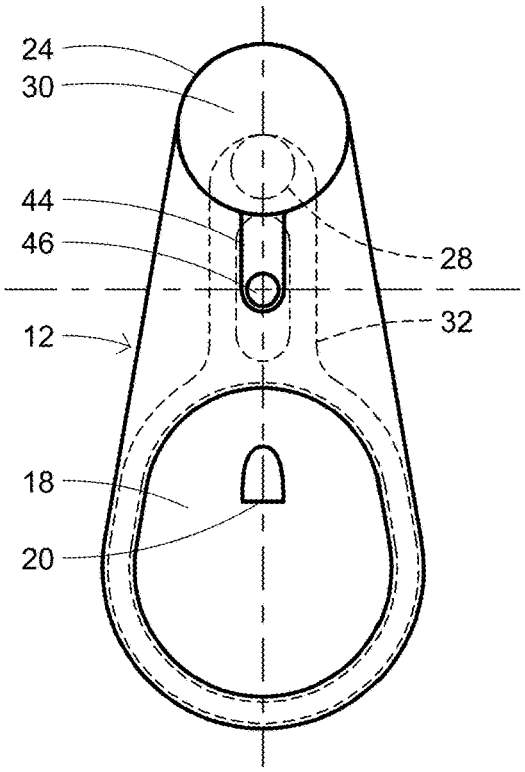
FIG. 6 is a top view of the toilet portion of the combination toilet and sink assembly shown in FIG. 1 with the flow structure for the water from the tank reservoir being shown in dotted lines.
Figure 7:
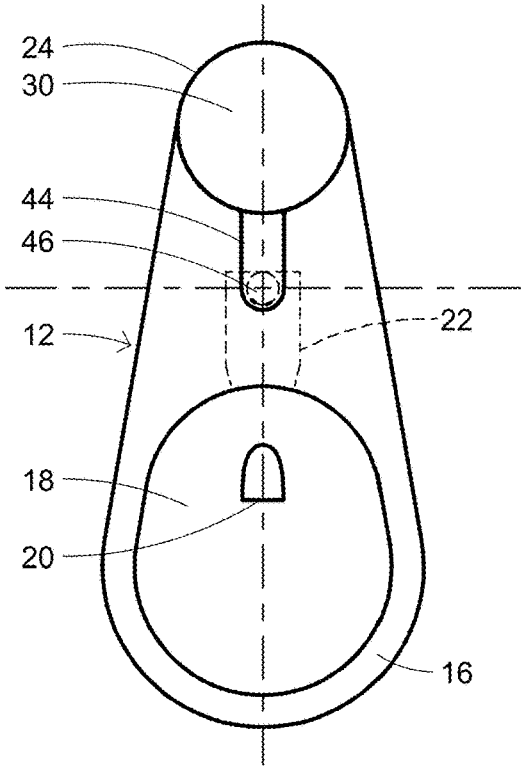
FIG. 7 is a top view of the toilet portion of the combination toilet and sink assembly shown in FIG. 1 with the flow structure for the water from the faucet drain being shown in dotted lines.
Figure 13:
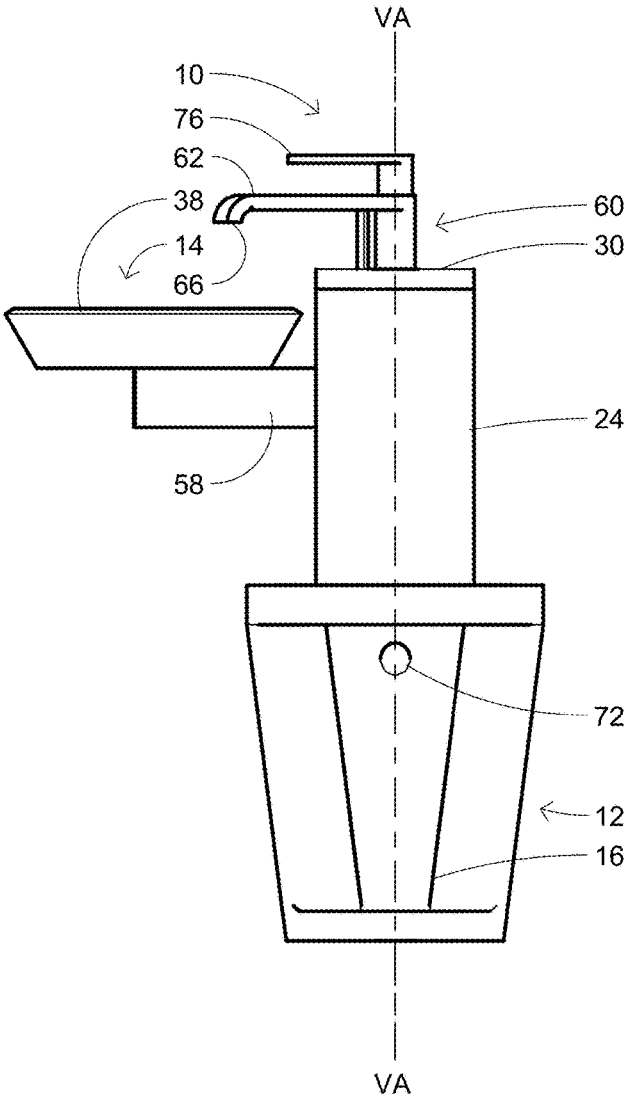
FIG. 13 is a rear view of the combination toilet and sink assembly shown in FIG. 1 with the sink portion in a state in which it is above the toilet portion.
Figure 14:
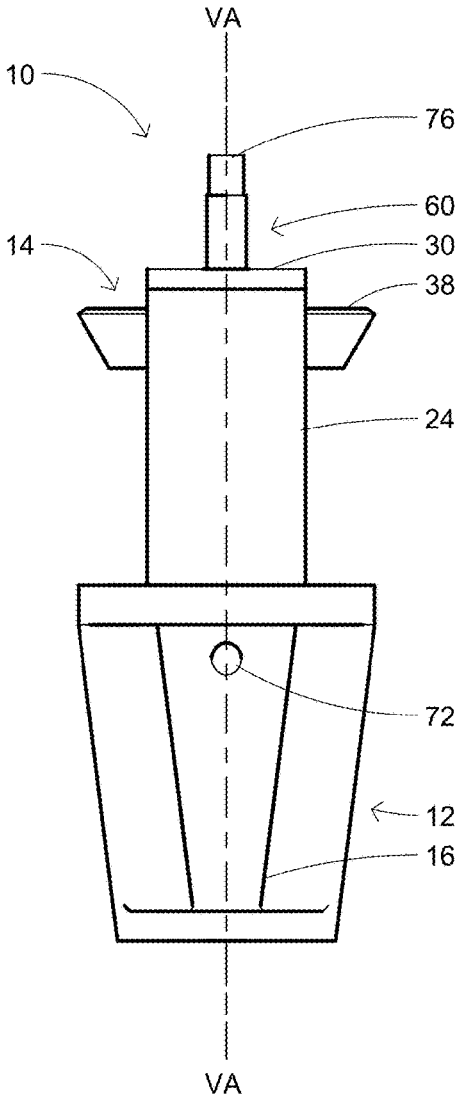
FIG. 14 is a rear view of the combination toilet and sink assembly shown in FIG. 1 with the sink portion in a state in which it is not above and to the side of the toilet portion.
Figure 15:
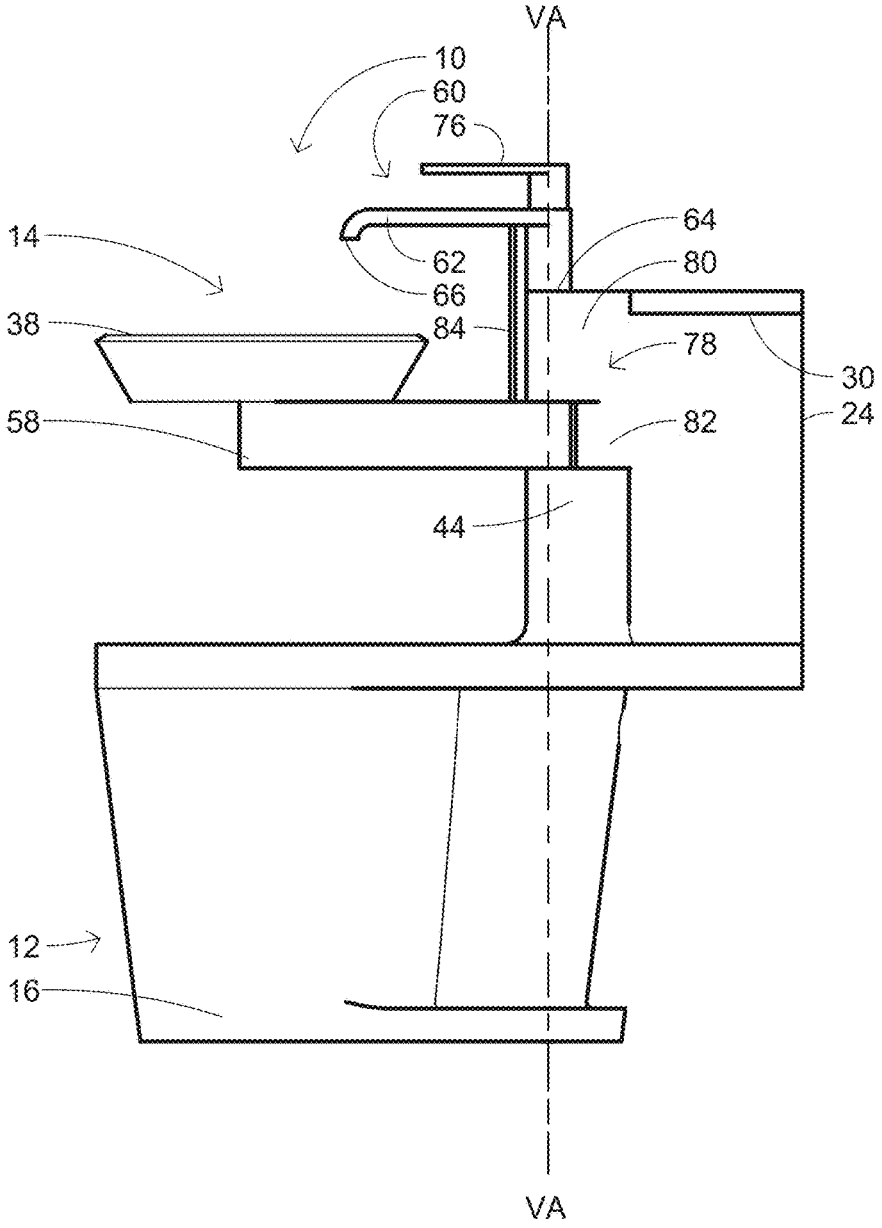
FIG. 15 is a right side view of the combination toilet and sink assembly shown in FIG. 1 with the sink portion in a state in which it is above the toilet portion.
Figure 16:
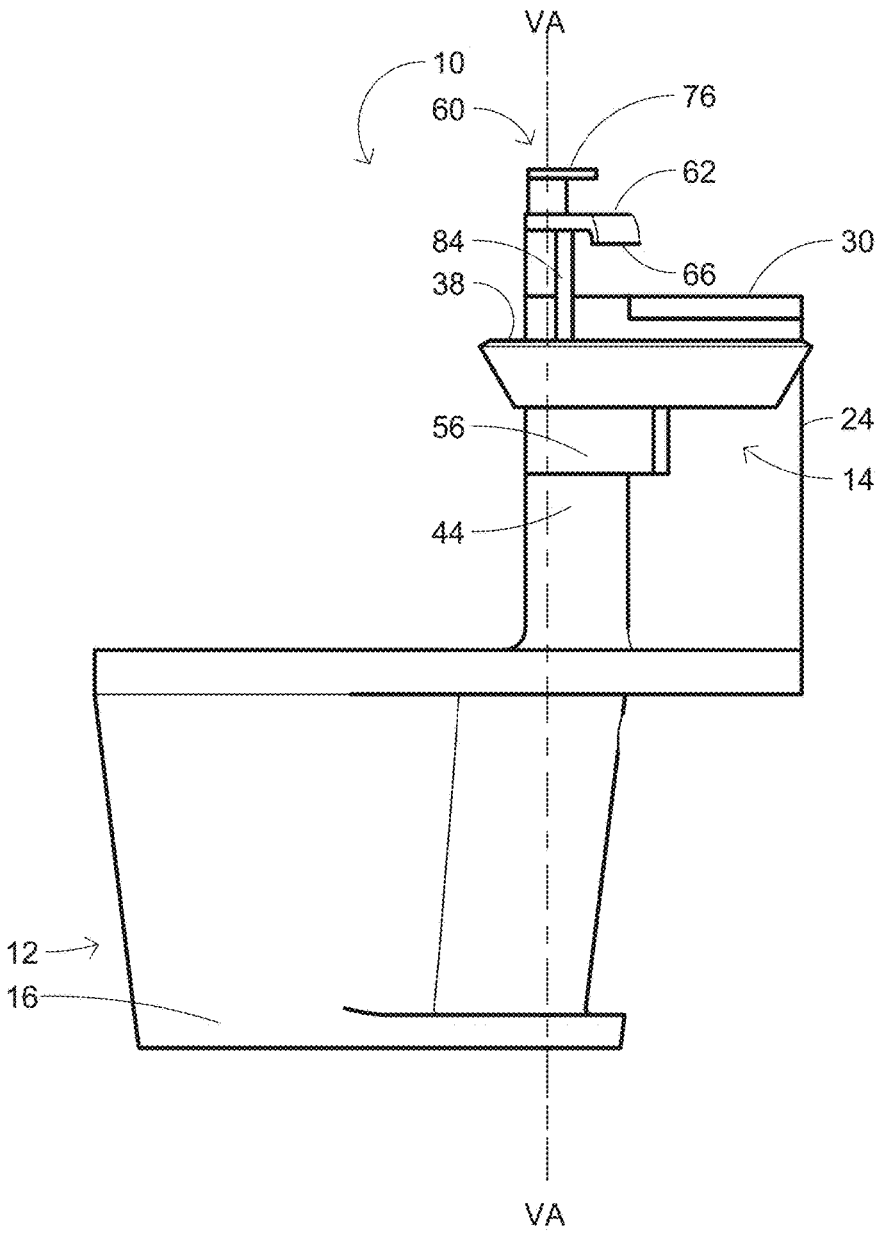
FIG. 16 is a right side view of the combination toilet and sink assembly shown in FIG. 1 with the sink portion in a state in which it is not above and to the side of the toilet portion.

In a preferred embodiment, the second position is about 90 degrees about the vertical axis VA from the first position, and in fact, a little more than 90 degrees as shown in FIG. 5. This allows the person unblocked use of the toilet portion of the assembly 10 since the sink 38 is entirely to the side and not over any portion of the waste receptacle 18. Compare also FIGS. 13 and 16 showing the position in which the sink is swung away from a position directly above the waste receptacle 18 to enable use of the waste receptacle 18 (toilet) to FIGS. 14 and 15 in which the sink 38 is directly over the waste receptacle 18 and does not allow for use thereof.

The base 16 includes features to enable the sink portion 14 to function. Specifically, the base 16 includes a projection 44 extending upward from the upper surface of the base 16 alongside the waste receptacle 18. As shown, the projection 44 is rearward of the waste receptacle 18 and forward of the reservoir tank 24, i.e., between these two elements, and in a central region of the base 16. The projection 44 may be alongside and in contact with the front surface of the reservoir tank 24, as seen in FIG. 10. The projection 44 includes an elongate, vertically oriented channel 46.

The conduit member 42 includes a vertical portion 48 rotatable in the channel 46 and a horizontal portion 50 above the vertical portion 48, thereby forming an elbow 52. Channel 22 in the base 16 is under the channel 46 in the projection 44 and in flow communication therewith and thus also in flow communication with the vertical portion 48 of the conduit member 42 in the channel 46 (see FIG. 10). The horizontal portion 50 is partly under the sink 38. A casing 54 encloses a portion of the horizontal portion 50 of the conduit member 42 between the drain 40 and the reservoir tank 24. The casing 54 is shown as a two-part casing 56, 58 with each part including a channel adapted to the shape of the horizontal portion 50 of the conduit member 42 (see FIG. 3).

The sink portion 14 also includes a pivotable faucet 60 having a spout or conduit member 62 defining a water channel with a water inlet 64 and a water outlet 66 that is at a vertical height above the sink 38. The faucet 60 may be coupled to the conduit member 42 such that it also pivots upon pivotal movement of the conduit member 42. As such, when a person takes hold of the sink 38 to pivot it about the vertical axis VA, the person is able to cause pivotal movement of the sink 38, the conduit member 42 and the faucet 60. In a similar manner, by taking hold of the faucet 60 and pivoting it about the vertical axis VA, the person is able to cause pivotal movement of the sink 38, the conduit member 42 and the faucet 60 as a unit. By aligning the pivot points of the sink drain 40 and faucet 60, both parts can remain aligned in any position. The reservoir tank 24 acts as a stabilizer and clamp.

In one embodiment, the faucet 60 may be coupled to the casing 54 to provide for linked pivotal movement of the conduit member 42, the casing 54 and the faucet 60. In such an embodiment, the sink 38, the conduit member 42 inside the casing 54 and the faucet 60 all pivot about the same vertical axis VA. Such linked pivotal movement though is not required in all embodiments of the invention. In this case, it is possible that the sink 38 and conduit member 42 inside the casing 54 could pivot about a different axis than the faucet 60, e.g., a different vertical axis.

An alignment member, such as an alignment pin 68, may be provided and arranged partly in an aperture in the casing 54 and partly in an aperture in the reservoir tank 24 above the casing 54, see FIG. 10, to facilitate the pivotal movement of the casing 54 and thus the conduit member 42 partly enclosed thereby and the sink 38. Also, the alignment pin 68 aids in supporting the swing arm cantilever provided by the conduit member 42 and casing 54.

To provide water for the faucet 60, the assembly 10 includes a fourth conduit 70 partly in the projection 44 in the base 16 and partly in the reservoir tank 24 (see FIG. 10). Fourth conduit 70 has a water inlet 72 at the bottom of the part 70A in the base 16 adapted to be coupled to an external source of water in a conventional manner, and a water outlet 74 at the top of the part 70B in the reservoir tank 24 communicating with the water inlet 64 of the faucet 60. The faucet 60 includes a handle 76 or other flow control device to enable the inflow of water from the water outlet 74 of the fourth conduit 70 to the faucet 60, and thus through the faucet 60 to the water outlet 66 thereof, to be controlled as desired.

Figure 3:
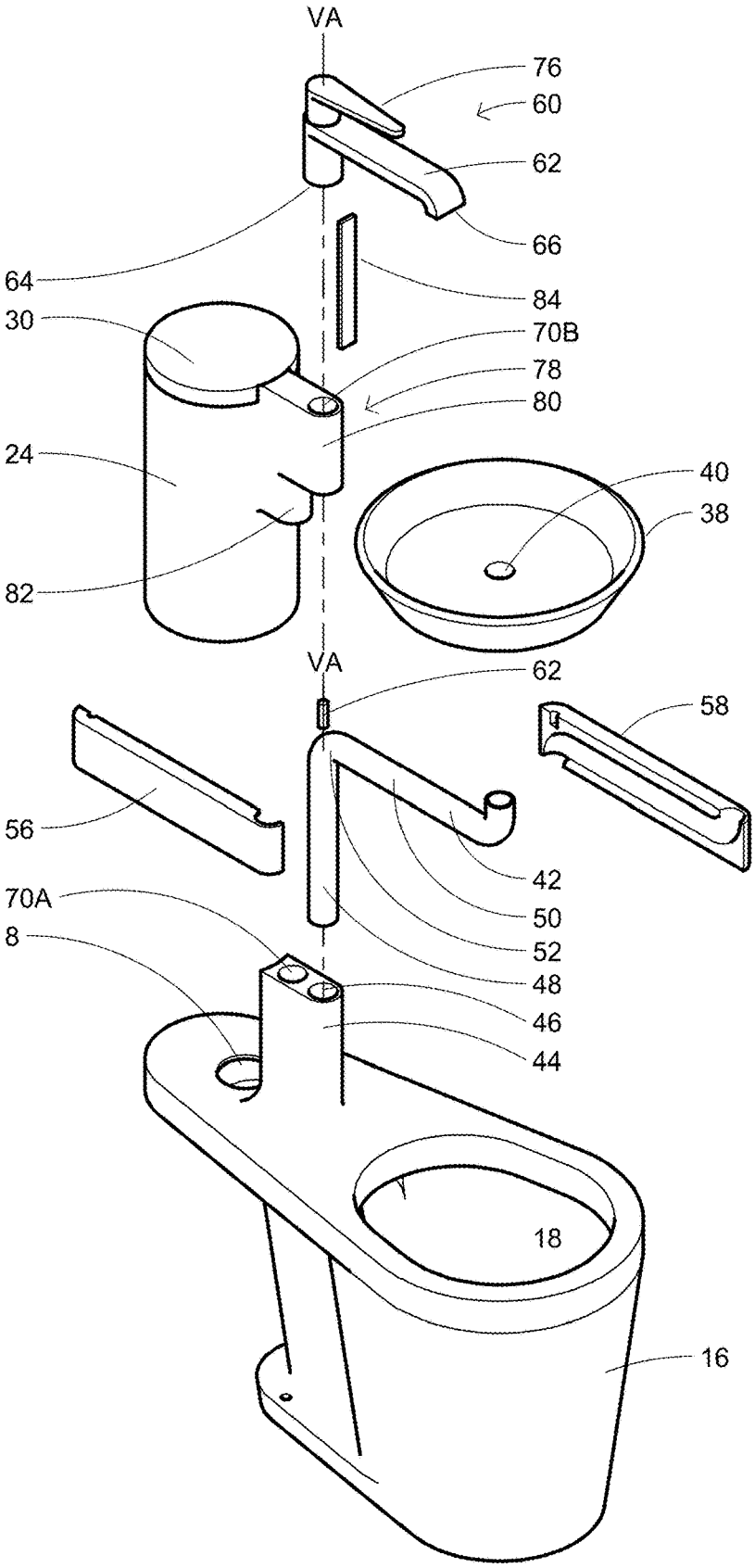
FIG. 3 is an exploded view of the combination toilet and sink assembly shown in FIG. 1.
Figure 4:
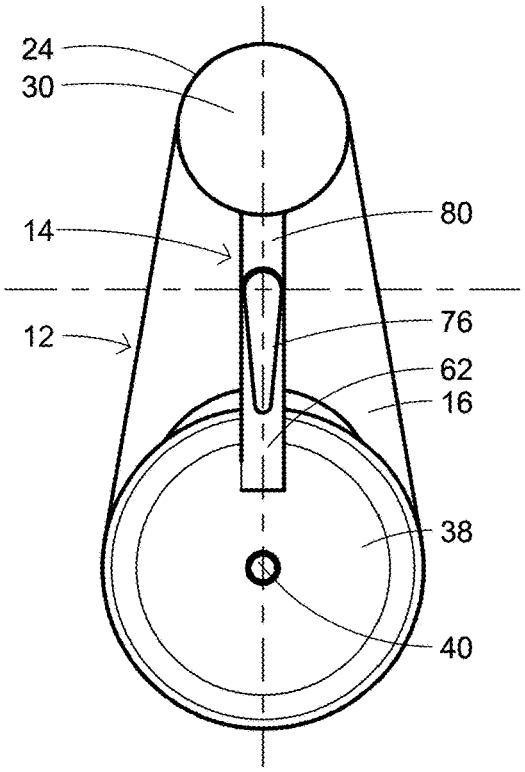
FIG. 4 is a top view of the combination toilet and sink assembly shown in FIG. 1 with the sink portion in a state in which it is above the toilet portion.

As shown in FIG. 3, and as also can be seen from FIG. 10, the part 70A of the fourth conduit 70 that is in the projection 44 in the base 16 is behind the channel 46 in the projection 44, i.e., in line therewith but closer to the water receptacle 26 in the reservoir tank 24. In this manner, it is possible for the sink 38 and connected structure, i.e., the conduit member 42, the casing 54 and the faucet 60, to pivot in both directions about the vertical axis VA, i.e., to the left and to the right of the waste receptacle 18. This is very useful since the assembly 10 could be assembled and allow for both leftward pivotal movement of the sink 38 and associated structure and also rightward movement of the sink 38 and associated structure. There is no need to construct separate assemblies with a left pivoting sink and another one with a right pivoting sink. Rather, a single assembly addresses both installation.

Although it is possible to position the part of the fourth conduit 70 that is in the projection 44 in the base 16 and the channel 46 in the projection 44 in a side-by-side arrangement, this would substantially limit the design to allow for pivotal movement of the sink 38 and associated structure in essentially only one direction from the position above the waste receptacle 18, i.e., toward the side away from the part of the fourth conduit 70. As such, it would be necessary to construct an assembly with a left-handed swinging sink 38 and another assembly with a right-handed swinging sink 38, the relative position of the part of the fourth conduit 70 that is in the projection 44 in the base 16 and the channel 46 in the projection 44 being switched between these embodiments. Nevertheless, such right-hand only or left-hand only sink swinging embodiments are within the scope of the invention. As such, the projection 44 is constructed to provide the position of the part of the fourth conduit 70 and the channel 46 preferably as shown, but this positioning is not intended to limit the invention.

To provide a support for the faucet 60, the reservoir tank 24 includes a protrusion 78 on a front side, i.e., the side facing the waste receptacle 18. This protrusion 78 has an upper portion 80 projecting more forward than a lower portion 82. A portion of the fourth conduit 70 passes through the protrusion 78 (see FIG. 10). The upper portion 80 of the protrusion 78 supports the faucet 60 and has an opening through which water operatively flows from the fourth conduit 70 into the faucet 60. Sealing structure for this flow connection is present, but not shown. The aperture into which the alignment pin 68 is received is formed on a lower surface of the upper portion 80 of the protrusion 78. The lower portion 82 of the protrusion 78 is adjacent a rear end region of the casing 54.

An elongate movement synchronizing bar 84 is also optionally provided, connected at one end to the faucet 60, e.g., the spout 62 thereof, and rests on the casing 54. The bar 84 prevents user error and hassle since it enables synchronized or linked movement of the sink 38 and faucet 60 (in the embodiment wherein the sink 38 and faucet 60 rotate about the same vertical axis VA), but has no bearing on functionality otherwise since such synchronized or linked pivotal movement is not required. In an embodiment wherein the synchronizing bar 84 is not provided, the user would have to independently swing the sink 38 and the conduit member 42 and casing 54 unit, and then also swing the faucet 60, which could swing about the same vertical axis VA or different axes, and not even different vertical axes since one or more of the axes could be other than vertical.

Although the assembly 10 is described above as a combination of a toilet portion 12 and a sink portion 14, each of these portions could be used independently, e.g., the toilet portion 12 could be used with a different sink portion and the sink portion could be used with a different toilet portion, provided the other portion has the necessary fluid connections. Thus, the toilet portion and the sink portion should also be considered separate and independent inventions. Preferably though, they are used together connected in the manner disclosed above.

Another variant of the invention is an assembly wherein the reservoir tank 24 is not a stabilizer tank per se. Rather, the water receptacle to enable flushing of the toilet is provided by a wall-mounted reservoir or a tankless commercial toilet setup. In such embodiments, both the swing arm (the conduit member 42 and its casing 54), and the faucet 60 will be supported only by the upright projection 44 of the base 16, without a reservoir tank behind the projection 44.

Another embodiment of the invention includes a wall-mounted bowl, instead of mounting the toilet portion 12 onto a horizontal surface. In this case, the toilet base 16 may be configured to provide for a waste outlet into a vertical wall instead of a horizontal floor, i.e., from a rear surface on a side of the toilet base 16. In such an embodiment, the second conduit 34 in the toilet base 16 would extends from the outlet 20 of the waste receptacle 18 to an opening in the rear surface of the toilet base 16 at a vertical height below the outlet 20 of the waste receptacle 18. Suitable mounting connections are provided in the vertical wall, and in the rear, wall-facing surfaces of the toilet base 16.

Dimensions for the components of the assembly 10 are not provided herein. Such dimensions are determined by building code clearances. In one embodiment, the assembly 10 can be constructed so that, when applied to residential spaces, the assembly 10 yields a minimum usable area that is about 40% smaller than the area of a typical sink-toilet setup. As such, even the tapered shapes are intentional to allow for use of a standard sized sink and toilet.

Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is limited only by the following claims. Among other modifications, features of the U.S. and foreign patent documents mentioned above, all of which are incorporated by reference herein, can be used in the combination toilet and sink assembly in accordance with the invention to the extent possible, and all such modifications are considered by the inventor to be part of the invention.

The foregoing detailed description provides an explanation of various aspects of the disclosed technique for combining toilet functions and sink functions in a common unit or assembly. The purpose of this explanation is to provide a thorough understanding of the different aspects of the disclosed assembly. This description is not intended to limit the scope, applicability, or configuration of the disclosed assembly. It will also be apparent to one skilled in the art that the disclosure may be practiced without specific details being presented herein. Various changes may be made in the function and arrangement of elements without departing from the spirit and scope of the disclosed assembly as set forth in the appended claims. Furthermore, well-known features may be omitted or simplified for clarity.

To aid in describing the disclosed assembly, directional terms may be used in the specification and claims to describe portion of the present assembly (e.g., upper, lower, left, right, etc.) These directional definitions are merely intended to assist in describing and claiming the disclosed assembly and are not intended to limit the disclosed assembly in any way. In addition, reference numerals that are introduced in the specification in association with a drawing figure may be repeated in one or more subsequent figure without additional description in the specification, in order to provide context for the other features.

The invention claimed is:

1. A combination toilet and sink assembly, comprising:

a base defining a water inlet, a waste receptacle having an outlet in a bottom region and a channel leading into said waste receptacle separate from said water inlet;

a first conduit in said base extending from said water inlet of said base to said waste receptacle;

a second conduit in said base extending from said outlet of said waste receptacle to an outer surface of said base at a vertical height below said outlet of said waste receptacle to enable outflow of waste water in said waste receptacle from said base;

a sink having a drain;

a conduit member connected at one end region to said drain of said sink and extending from said drain of said sink to said channel of said base, said conduit member defining part of a third conduit from said drain to said waste receptacle and being pivotable about a substantially vertical axis such that said sink pivots upon pivotal movement of said conduit member;

a pivotable faucet having a spout, a water inlet to said spout, and a water outlet from said spout at a vertical height above said sink; and a fourth conduit having a water inlet adapted to be coupled to a source of water and a water outlet communicating with said water inlet of said spout of said faucet, whereby said first conduit in said base is in fluid communication with a source of water to enable controllable inflow of water from the source of water into said water inlet and through said first conduit into said waste receptacle; and whereby the inflow of water from said water outlet of said fourth conduit to said spout of said faucet is controllable.

2. The assembly of claim 1, wherein said faucet includes a handle for controlling flow of water from said water outlet of said fourth conduit to said water inlet of said spout of said faucet and then through said spout to said water outlet of said spout of said faucet, said faucet being pivotable about the same substantially vertical axis as said conduit member.

3. The assembly of claim 1, further comprising a reservoir tank coupled to said base and having a water receptacle, a water inlet to said water receptacle adapted to be coupled to the source of water and a water outlet from said water receptacle at a bottom region of said reservoir tank at a vertical height above at least part of said waste receptacle, said first conduit extending from said water outlet of said reservoir tank to said waste receptacle to enable inflow of water from said water outlet of said reservoir tank into said waste receptacle, whereby the inflow of water from said water outlet of said reservoir tank into said waste receptacle is controllable.

4. The assembly of claim 3, wherein said reservoir tank includes a protrusion on a front side, said faucet being supported on said protrusion, and a portion of said fourth conduit passing through said protrusion.

5. The assembly of claim 3, wherein said first conduit extends from said water outlet of said reservoir tank to an upper region of said waste receptacle and is at least partly formed in an upper region of said base.

6. The assembly of claim 3, wherein said fourth conduit is defined partly in said reservoir tank and partly in said base.

7. The assembly of claim 1, wherein said conduit member is configured to be pivotable between a first position in which said sink is in a position directly above at least part of said waste receptacle and a second position in which said sink is in a position not above said waste receptacle to enable use of said waste receptacle.

8. The assembly of claim 7, wherein said second position is about 90 degrees about the substantially vertical axis from the first position.

9. The assembly of claim 1, further comprising a casing that encloses a portion of said conduit member between said drain of said sink and said base.

10. The assembly of claim 9, wherein said faucet is coupled to said casing to provide for linked pivotal movement of said sink, said conduit member, said casing and said faucet.

11. The assembly of claim 9, further comprising:

a reservoir tank coupled to said base and having a water receptacle, a water inlet to said water receptacle adapted to be coupled to the source of water and a water outlet from said water receptacle at a bottom region of said reservoir tank at a vertical height above at least part of said waste receptacle, said first conduit extending from said water outlet of said reservoir tank to said waste receptacle; and an alignment pin arranged partly in an aperture in said casing and partly in an aperture in said reservoir tank above said casing to thereby facilitate the pivotal movement of said casing and a portion of said conduit member enclosed thereby.

12. The assembly of claim 1, wherein said base further comprises a projection alongside said waste receptacle, said projection including a portion of said fourth conduit and a channel in which a portion of said conduit member is situated.

13. The assembly of claim 12, further comprising:

a reservoir tank coupled to said base and having a water receptacle, a water inlet to said water receptacle adapted to be coupled to the source of water and a water outlet from said water receptacle at a bottom region of said reservoir tank at a vertical height above at least part of said waste receptacle, said first conduit extending from said water outlet of said reservoir tank to said waste receptacle; and wherein said projection is rearward of said waste receptacle, said water receptacle of said reservoir tank is rearward of said projection, and said portion of said fourth conduit is rearward of said channel to allow for pivotal movement of said sink to both sides of said base.

14. The assembly of claim 13, wherein said conduit member includes a vertical portion rotatable in said channel and a horizontal portion above said vertical portion and at least partly under said sink.

15. The assembly of claim 14, further comprising a casing around said horizontal portion of said conduit member.

16. The assembly of claim 14, wherein said channel in said base is rearward of said waste receptacle, under said channel in said projection and in flow communication with said vertical portion of said conduit member.

17. A toilet for a combination toilet and sink assembly, the toilet comprising:

a base defining a water inlet, a waste receptacle having an outlet in a bottom region and a channel leading into said waste receptacle separate from said water inlet;

a first conduit in said base extending from said water inlet of said base to said waste receptacle;

a second conduit in said base extending from said outlet of said waste receptacle to an outer surface of said base at a vertical height below said outlet of said waste receptacle to enable outflow of waste water in said waste receptacle from said base;

a projection on said base alongside said waste receptacle, said projection including a channel in flow communication with said channel in said base and adapted to receive a conduit member that defines a third conduit; and a fourth conduit defined partly in said projection of said base and having a water inlet adapted to be coupled to a source of water and a water outlet, whereby said first conduit in said base is in fluid communication with the source of water to enable controllable inflow of water from the source of water into said water inlet and through said first conduit into said waste receptacle; and whereby when the toilet is connected to a sink having a faucet and a drain, the conduit member received in said channel of said projection is connected to a drain of the sink and said water outlet of said fourth conduit is coupled to a water inlet of the faucet.

18. The toilet of claim 17, further comprising:

a reservoir tank coupled to said base and having a water receptacle, a water inlet to said water receptacle adapted to be coupled to the source of water and a water outlet from said water receptacle at a bottom region of said reservoir tank at a vertical height above at least part of said waste receptacle, said first conduit extending from said water outlet of said reservoir tank to said waste receptacle to enable inflow of water from said water outlet of said reservoir tank into said waste receptacle, said fourth conduit being defined partly in said reservoir tank, whereby the inflow of water from said water outlet of said reservoir tank into said waste receptacle is controllable, and wherein said projection is rearward of said waste receptacle and said water receptacle of said reservoir tank is rearward of said projection.

19. A sink assembly for a combination toilet and sink assembly, the sink assembly comprising:

a sink having a drain;

a conduit member connected at one end region to said drain of said sink, said conduit member defining part of a first conduit from said drain and including a vertical portion and a horizontal portion above said vertical portion and at least partly under said sink;

a pivotable faucet having a spout, a water inlet to said spout, and a water outlet from said spout at a vertical height above said sink, said faucet being coupled to said sink such that upon pivotal movement of said conduit member, said sink and said faucet pivot;

said faucet including a handle for controlling flow of water through said spout from said water inlet of said spout to said water outlet of said spout;

whereby upon placement of said vertical portion of said conduit member into a channel of a toilet base of the combination toilet and sink assembly, said conduit member is pivotable, and whereby upon connection of said water inlet of said spout of said faucet to a second conduit passing through the toilet base of the combination toilet and sink assembly, water is suppliable to said spout.

20. The sink assembly of claim 19, further comprising a casing around said horizontal portion of said conduit member.

* * * * *